US009617115B2

(12) United States Patent
Sarjanen et al.

(10) Patent No.: US 9,617,115 B2
(45) Date of Patent: Apr. 11, 2017

(54) METHOD FOR DETERMINING AND USING PARAMETERS ASSOCIATED WITH RUN TIME OF ELEVATORS AND AN ELEVATOR SYSTEM CONFIGURED TO PERFORM SAME

(71) Applicants: Jukka-Pekka Sarjanen, Vantaa (FI); Niko Elomaa, Hyvinkaa (FI)

(72) Inventors: Jukka-Pekka Sarjanen, Vantaa (FI); Niko Elomaa, Hyvinkaa (FI)

(73) Assignee: Kone Corporation, Helsinki (FI)

( * ) Notice: Subject to any disclaimer, the term of this patent is extended or adjusted under 35 U.S.C. 154(b) by 458 days.

(21) Appl. No.: 14/190,616

(22) Filed: Feb. 26, 2014

(65) Prior Publication Data

US 2014/0174861 A1 Jun. 26, 2014

Related U.S. Application Data

(63) Continuation of application No. PCT/FI2012/050841, filed on Aug. 30, 2012.

(30) Foreign Application Priority Data

Aug. 31, 2011 (FI) ..... 20115850

(51) Int. Cl.
*B66B 1/18* (2006.01)
*B66B 1/34* (2006.01)
(Continued)

(52) U.S. Cl.
CPC ..... *B66B 1/3407* (2013.01); *B66B 1/2458* (2013.01); *B66B 5/0037* (2013.01);
(Continued)

(58) Field of Classification Search
CPC ..... B66B 1/34; B66B 1/2458; B66B 5/0037; B66B 1/3407; B66B 19/007;
(Continued)

(56) References Cited

U.S. PATENT DOCUMENTS 4,367,811 A 1/1983 Yoneda et al.
4,700,810 A 10/1987 Otala
(Continued)

FOREIGN PATENT DOCUMENTS

EP 0477976 A2 4/1992
GB 2180960 A 4/1987
(Continued)

OTHER PUBLICATIONS

Finnish Search Report for application No. 20115850 dated Jan. 1, 2012.
(Continued)

*Primary Examiner* — Anthony Salata
(74) *Attorney, Agent, or Firm* — Harness, Dickey & Pierce, P.L.C.

(57) ABSTRACT

A method for determining the parameters connected to the run times of elevators and for using said parameters in the control of the elevators in an elevator system includes selecting a plurality of floor pairs from a plurality of floors served by the elevators; measuring runs between the selected floor pairs with one or more elevators; registering run events connected to the measured runs; determining, on the basis of the run events, a plurality of run time parameters connected to the run times; and controlling the elevators based on the aforementioned run time parameters when the elevators are in transport operation.

17 Claims, 3 Drawing Sheets

Figure 1:
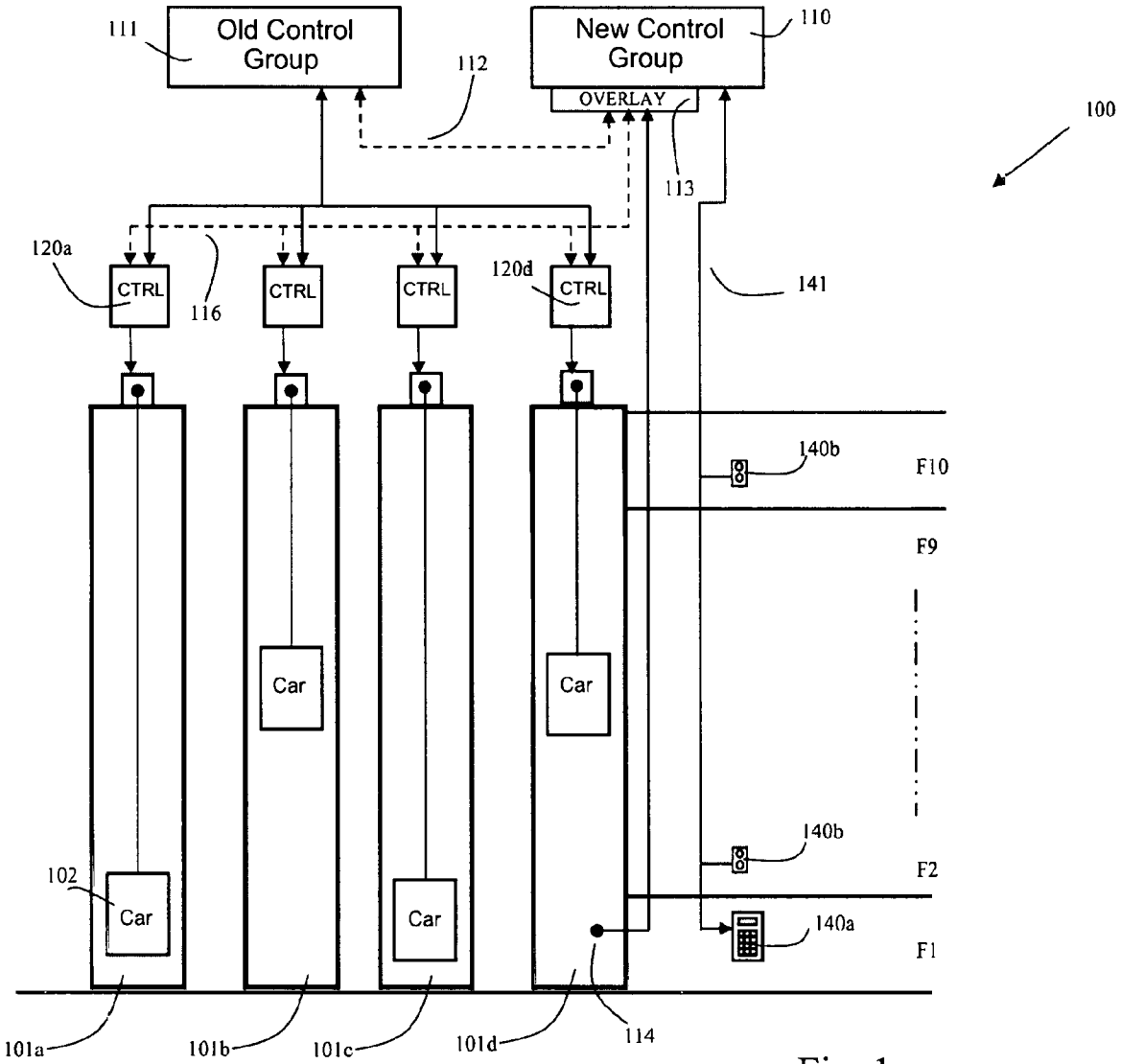

(51) Int. Cl.
*B66B 1/24* (2006.01)
*B66B 5/00* (2006.01)
*B66B 19/00* (2006.01)

(52) U.S. Cl.
CPC ..... *B66B 19/007* (2013.01); *B66B 2201/102* (2013.01); *B66B 2201/103* (2013.01); *B66B 2201/211* (2013.01); *B66B 2201/222* (2013.01)

(58) Field of Classification Search
CPC ..... B66B 2201/102; B66B 2201/103; B66B 2201/211; B66B 2201/222
USPC ..... 187/247, 380–389, 391, 393
See application file for complete search history.

(56) References Cited

U.S. PATENT DOCUMENTS 5,157,228 A 10/1992 Ackermann et al.
5,352,857 A 10/1994 Ovaska
5,767,461 A * 6/1998 Nakagawa ..... B66B 1/2458 187/247
5,907,137 A * 5/1999 Tyni ..... B66B 1/2408 187/380
6,325,179 B1 12/2001 Barreiro et al.
6,913,117 B2 * 7/2005 Tyni ..... B66B 1/20 187/382
6,978,863 B2 * 12/2005 Hikita ..... B66B 1/18 187/382
7,484,597 B2 * 2/2009 Nikovski ..... B66B 1/18 187/247
7,743,890 B2 * 6/2010 Nikovski ..... B66B 1/2458 187/247
8,003,907 B2 * 8/2011 Hoshino ..... B66B 3/00 200/308
8,151,943 B2 * 4/2012 de Groot ..... B66B 1/2458 187/382
8,220,591 B2 * 7/2012 Atalla ..... B66B 1/20 187/383
8,662,256 B2 * 3/2014 Asano ..... B66B 1/2458 187/380
9,284,158 B2 * 3/2016 Sarjanen ..... B66B 1/468
2004/0206583 A1 10/2004 Mearns et al.
2005/0077117 A1 4/2005 Shrum et al.
2008/0060883 A1 3/2008 Tyni et al.
2008/0230326 A1 9/2008 Tyni et al.
2014/0131142 A1 * 5/2014 Parkkinen ..... B66B 3/006 187/382
2016/0130112 A1 * 5/2016 Nikovski ..... B66B 1/3407 187/247

FOREIGN PATENT DOCUMENTS

JP 2002114463 A 4/2002
JP 2005-200136 A 7/2005
WO WO-0114237 A1 3/2001
WO WO-03066497 A1 8/2003
WO WO-2006106174 A1 10/2006

OTHER PUBLICATIONS

International Search Report for PCT/FI2012/050841 dated Oct. 9, 2012.
Written Opinion for PCT/FI2012/050841 dated Oct. 9, 2012.
Extended European Search Report dated Mar. 4, 2015 issued in corresponding European Application No. 12827039.4.

* cited by examiner

METHOD FOR DETERMINING AND USING PARAMETERS ASSOCIATED WITH RUN TIME OF ELEVATORS AND AN ELEVATOR SYSTEM CONFIGURED TO PERFORM SAME

This application is a continuation of PCT International Application No. PCT/FI2012/050841 which has an International filing date of Aug. 30, 2012, and which claims priority to Finnish patent application number 20115850 filed Aug. 31, 2011, the entire contents of both which are incorporated herein by reference.

The invention relates to elevator systems. More particularly the invention relates to determining the parameters connected to the run times of elevators and to the use of these in controlling the elevators in elevator systems.

BACKGROUND OF THE INVENTION

The optimal control and allocation of the elevators in an elevator group is contingent on, inter alia, the group control of the elevator group having sufficiently accurate data for calculating and predicting the run times of the elevators. The parameters to be used in calculating run times are generally determined manually and recorded e.g. in the group control permanently. It is also possible that the group control receives some of the data needed in the calculation of the run times from other control apparatuses of the elevator group, e.g. from elevator-specific control apparatuses (from the elevator controls). When modernizing elevators, the parameters connected to run times are not generally known and often it is necessary to give rough default values for them. This easily results in under-utilization of the transport capacity of the elevator group, especially in the starting phase of modernization, because the new modernized group control is not able to distribute calls optimally between the modernized and the unmodernized elevators. In addition, it is necessary to make complex connections between the old group control and the new group control and also to install a possibly large plurality of sensors detecting the position at cetera, of the elevator cars so that the new group control would have sufficient position data and status data about the elevators to be modernized for controlling the elevators during the modernization.

AIM OF THE INVENTION

The aim of the present invention is to eliminate or at least to alleviate the aforementioned drawbacks that occur in prior-art solutions. The aim of the invention is also to achieve one or more of the following objectives:

- an automatic, self-learning elevator system for determining the run time parameters connected to run times,
- an elevator system that is able to adaptively correct run time parameters during the normal transport operation of the elevators,
- a simple and cost-effective solution for the modernization of elevator systems,
- a solution that facilitates and speeds up the modernization and commissioning of elevator systems, and
- a solution that improves the transport capacity of elevator groups, more particularly during modernizations.

SUMMARY OF THE INVENTION

The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the scope of the basic inventive concept in conjunction with other embodiments.

The present invention discloses a method for determining the run time parameters connected to run times and for using said parameters in the control of the elevators in an elevator system, which comprises one or more elevators. According to the method a plurality of floor pairs are selected from the plurality of floors served by the elevators and measuring runs are performed with one or more elevators between the selected floor pairs, the run events connected to which measuring runs are registered. On the basis of the run events a plurality of run time parameters are determined, which after this are used for controlling the elevators when the elevators are in normal transport operation.

The present invention also discloses an elevator system, which comprises one or more elevators as well as a control system controlling the elevators. The control system is arranged: to automatically generate calls for elevators for performing measuring runs between the desired floor pairs; to register the run events to be connected to the measuring runs; to determine on the basis of the registered run events a plurality of run time parameters to be connected to the run times; and to use the aforementioned run time parameters for controlling the elevators when the elevators are in normal transport operation.

A control system refers in this context to any one or more control apparatuses whatsoever used for the control of elevators, such as e.g. group control or elevator controls.

Run time parameters in this context mean data items by the aid of which the run time of an elevator run to be performed between any floor pair whatsoever can be calculated (predicted) and/or it can be deduced whether a call to a certain floor can be given to a moving elevator in sufficient time for the elevator (elevator car) to stop at the floor in question. The run time parameters can be set to be constants or to be a function of a desired magnitude, e.g. a function of the drive direction of the elevator (elevator car) and/or a function of the car load of the elevator.

Floor pair means any two floors whatsoever, between which at least one elevator operates such that an elevator journey between the floors does not require a change of elevator. Floor pairs can be selected e.g. such that the run distances connected to them differ from each other, i.e. the number of floors and/or floor-to-floor heights remaining between floor pairs differ from each other. Preferably the minimum number of floor pairs is selected as floor pairs such that they cover all possible run distance combinations. In this case the number of measuring runs to be performed with the elevators is minimized and determination of the run time parameters is speeded up because measuring runs do not need to be performed to all the possible floor pairs of the elevator system.

Measuring runs can be performed by automatically generating calls for elevators to floors according to the selected floor pairs. The elevator with which the measuring runs are performed at any given time is selected by placing the other elevators into service drive or into some other corresponding operating mode, which prevents the elevators in question from registering automatically generated calls and therefore from performing measuring runs.

In one embodiment of the invention during a measuring run a call to a floor between the floor pair is generated at a time determined by the given call advance. On the basis of run events registered during a measuring run it can be deduced whether an elevator stopped at the floor in question or whether the elevator continued its run to the original destination floor of the measuring run. Depending on the result of the deduction, the call advance can be either lengthened or shortened. The measuring run is repeated with different values for the call advance in the manner described above until the desired termination condition is fulfilled. After this the final value for the call advance is determined and it is recorded in the run time parameters for use in controlling the elevators when the elevators are in normal transport operation. A call advance can be specific to an elevator or common to all the elevators of an elevator system. The call advance can be a constant or it can be determined as a function of the run distance (departure floor–destination floor of a run) and/or as a function of car load and/or as a function of drive direction. Taking the travel distance into account in the call advance is generally essential because elevators do not on short run distances, e.g. between consecutive floors, reach the nominal speed set for them. By the aid of call advances the transport capacity of an elevator system can be improved, because, when allocating the elevators serving calls, also those elevators that are moving towards a call-giving floor and that also have time to stop at the floor in question can be taken into account in the allocation.

In one preferred embodiment of the invention the run time parameters are determined for the elevators to be modernized in the starting phase of the modernization of the elevator system. When the run time parameters have been determined, the run time parameters can be used for controlling the elevators to be modernized when the elevators are used for transporting passengers during the modernization. If it is an elevator group to be modernized, the modernization can be started by installing the new group control and by connecting it via a suitable overlay to the (old) group control that is to be modernized and/or to the elevator controls of the elevators to be modernized. The new group control automatically generates via the overlay calls for the old group control and/or for the elevators to be modernized for performing measuring runs. The new group control reads via the overlay the status data of the elevators to be modernized and registers the run events to be connected to the measuring runs. On the basis of the run events, the new group control determines the run time parameters of the elevators to be modernized, which parameters can be used during the modernization for controlling the elevators of the elevator group, e.g. for distributing calls between the unmodernized and the modernized elevators.

In one embodiment of the invention an elevator belonging to the elevator system is provided with at least one position sensor, on the basis of the signal produced by which the position data of the elevator is calibrated (it is determined at which the floor elevator car actually is). After the calibration the direction data of the elevator and also the run time of each run performed with the elevator from departure floor to destination floor are monitored. On the basis of the monitoring, the position data of the elevator is updated by adding to it or deducting from it a number of floors, which is obtained by comparing the measured run time to the run times between floor pairs obtained on the basis of the run time parameters and also by taking into account the drive direction of the run performed. As a result of the embodiment, the sensor system of the elevator system can be simplified and, inter alia, the startup phase of modernization can be speeded up because position sensors do not need to be installed on all the floors served by the elevator system.

In one embodiment of the invention the run events connected to elevator runs are registered when the elevators are in transport operation and the run time parameters are updated, if necessary, on the basis of the aforementioned run events. For example, if on the basis of run events it is observed that the run time between a certain floor pair is repeatedly longer than the run time calculated on the basis of the run time parameters, the run time parameters can be updated to correspond more accurately to the verified run time during transport operation. Also the call advances can be lengthened/shortened by monitoring during transport operation whether an elevator stops for a given call according to the call advance of the elevator. As a result of the embodiment, the run time parameters can be made to be more accurate and to adapt to changes occurring in the elevator system. As a result of the embodiment, rough default values can at first be given for the run time parameters, which values are specified more precisely during normal transport operation of the elevator system.

With the solution according to the invention numerous advantages are achieved compared to prior-art solutions. As a result of the invention, the run time parameters needed for optimizing the use of the elevators can be determined automatically, which facilitates and speeds up the commissioning of an elevator system. The solution according to the invention is particularly well suited to the modernizations of elevator systems because the amount of installation work needed is minimal and the transport capacity of the elevator system can be optimized already in the starting phase of modernization. Since the determination of the run time parameters occurs automatically, the number of manual errors also decreases. The values of the run time parameters can be updated also during normal transport operation, in which case the run time parameters can be made to be more accurate and to adapt to changes occurring in the elevator system.

LIST OF FIGURES

In the following, the invention will be described in detail by the aid of examples of its embodiments, wherein:

FIG. 1 presents one elevator system according to the invention, and

Figure 2:
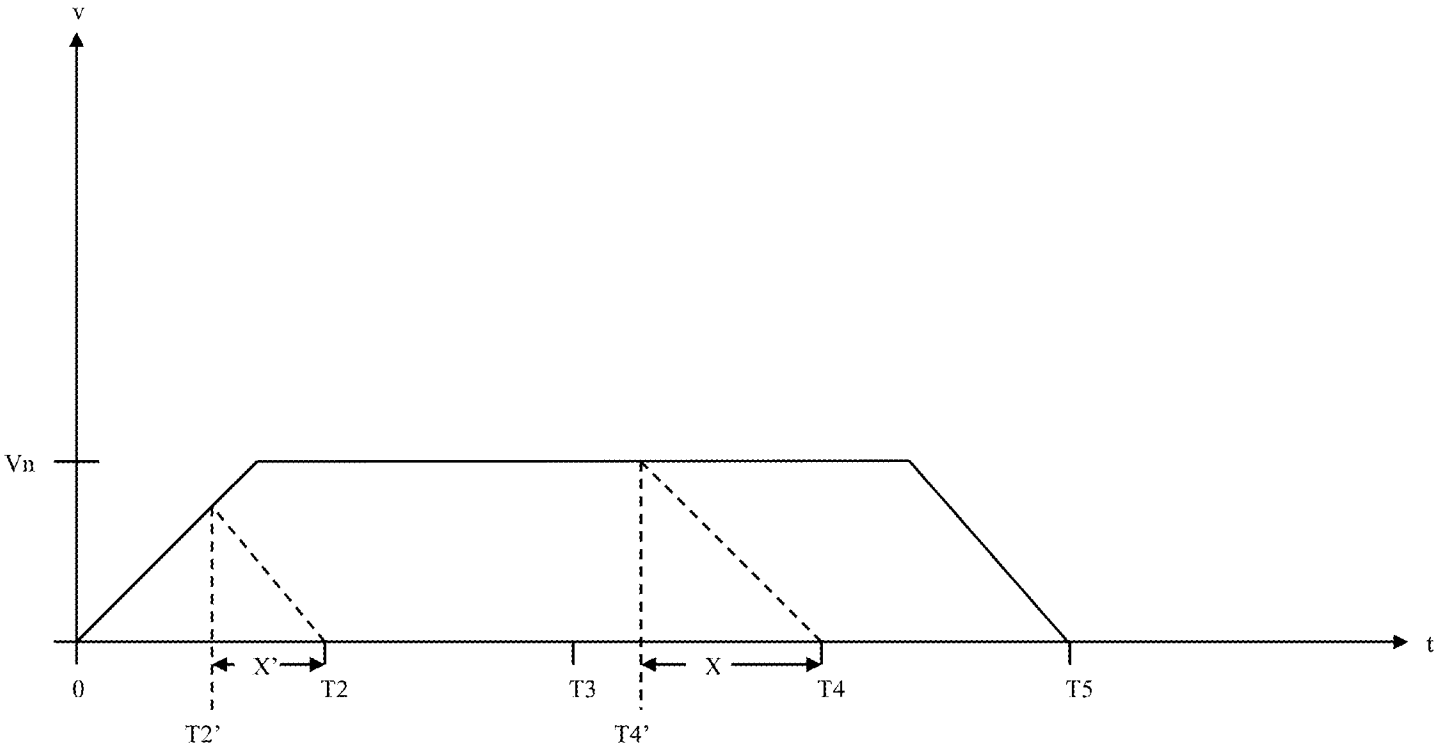

FIG. 2 illustrates a speed profile and a call advance of an elevator, and

Figure 3:
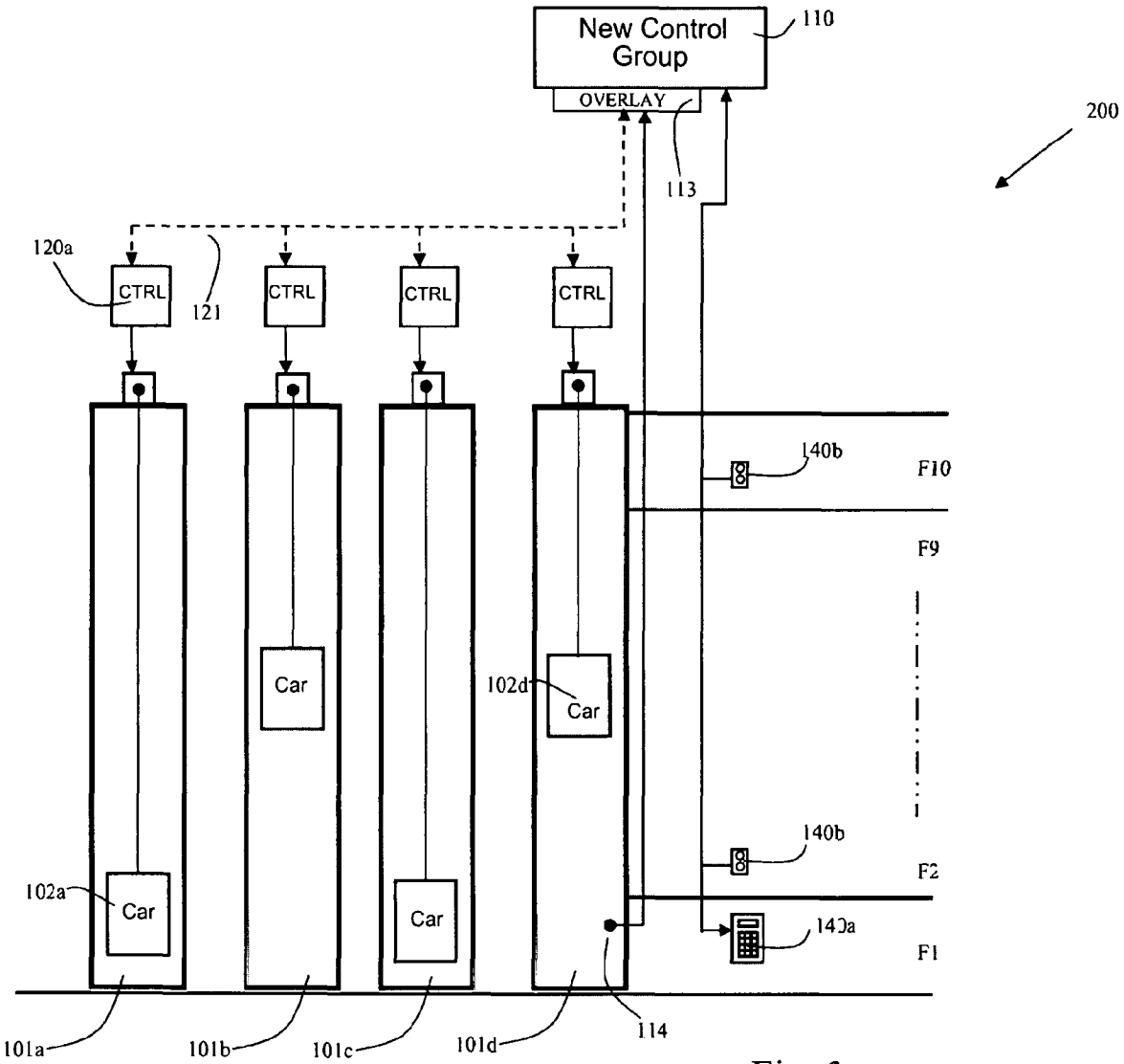

FIG. 3 presents a second elevator system according to the invention.

DETAILED DESCRIPTION OF THE INVENTION

In the following the invention will be described using the modernization of an elevator group as an example.

FIG. 1 presents an elevator group 100, comprising four elevators 101 (101*a*, 101*b*, 101*c* and 101*d*), an old group control 111 and a new group control 110 installed in the starting phase of the modernization. The elevators 101 serve the floors F1-F10 of the building. The old call-giving devices in the elevator lobbies of floors F1-F10 are replaced with new call-giving devices 140 (140.1, 140.2, . . . 140.10) and connected to the new group control via a device bus 141 suitable for the purpose. The new call-giving devices 140 can be any devices whatsoever suitable for giving calls, such as e.g. conventional up/down call pushbuttons (in FIG. 1 marked with the reference number 140.2 . . . 140.10) or destination call panels (in FIG. 1 marked with the reference number 140.1) suitable for giving destination calls and nowadays more widely used.

The new group control is connected via an interface (overlay) 113 to the old group control 111 and also to the elevator controls 120 (120*a* . . . 120*d*) of the old elevators to be modernized. The connections are implemented by installing cabling 112 between the overlay 113 and the old group control as well as cabling 116 between the overlay 113 and the elevator controls 120 (112 and 116 are presented with dashed lines in FIG. 1) The new group control generates via the overlay 113 calls for the old group control 111. The old group control registers the aforementioned calls and distributes them as run commands to the elevators to be modernized according to the allocation rules used in the old group control. The new group control 110 can read via the overlay 113 the status data of each elevator to be modernized, which data is e.g.: data about the drive direction (up/down) of the elevator and movement status (elevator driving/elevator standing still), door data (elevator car door closed/open), load-weighing data (load of elevator) and/or elevator position data (the floor at which the elevator car is). The use of overlay technology in modernizations of elevators is presented in e.g. publication U.S. Pat. No. 5,352,857, to which reference is made in this context.

In the starting phase of the modernization the elevators 101*b*, 101*c*, 101*d* are placed into service drive, in which case the new group control 110 can drive only the elevator 101*a* by sending automatically generated landing calls to the old group control 111. The floor pairs between which it is desired to perform the measuring runs are specified in the memory of the new group control. For example the following floor pairs (Table 1) are selected as floor pairs:

TABLE 1

| |
|---|
| F1-F2 |
| F1-F3 |
| F1-F4 |
| . . . |
| F1-F10 |

If the floor-to-floor height is essentially the same in all the floors F1, F2, . . . F10, the floor pairs of table 1 cover all the run distance combinations of the elevator group.

For performing the measuring runs the new group control sends to the old group control a landing call for driving the elevator 101*a* to floor F1. When the new group control ascertains on the basis of status data read via the overlay 113 that the elevator 101*a* has arrived at floor F1, the new group control sends to the old group control a landing call to floor F2, and measures the status data by monitoring the run time of the elevator 101*a* from floor F1 to floor F2. The new group control returns with a landing call the elevator 101*a* to floor F1, generates a landing call to floor F3 and measures the run time of the elevator 101*a* from floor F1 to floor F3. By generating automatic landing calls and by registering run events in the manner described above, the new group control measures the run time between all the floor pairs specified in Table 1. The run times are recorded in the memory of the new group control, e.g. in a table, such that the first index is the departure floor of the elevator run and the second index is the destination floor of the elevator run, and an element of the table thus obtained includes the run time between the departure floor and the destination floor.

In the example described above the elements (F1, F2), (F1, F3), . . . (F1, F10) are placed on the basis of the measured run times and are copied to other elements in which the run distance corresponds to the run distance of the measuring run performed. For example, the measured run time of the element (F1, F8) can be copied as the value of the elements (F2, F9), (F3, F10), (F9, F2) and (F10, F3) because in all the aforementioned floor pairs the run distance is the same (7 floors). If the floor-to-floor heights of a building are not the same, floor pairs are selected for measuring runs such that all the run distance combinations are taken into account. If the floor-to-floor heights are not known, measuring runs can be performed, if necessary, between all floor pairs.

For improving the accuracy of the run time parameters to be determined with measuring runs, the measuring runs between floor pairs can be performed separately both in the up direction and in the down direction, and the run time parameter recorded as a function of drive direction. Accuracy can be further improved by measuring the run times with different car loads and by recording the run time parameter as a function of car load. The car load can be measured with the car load weighing device in the elevator car or the car load can be estimated on the basis of calls, e.g. destination calls, given by passengers.

The floor pairs in Table 1 are only one example of floor pairs, which cover all the run distance combinations in the elevator system according to FIG. 1. FIG. 2 presents a second example of how floor pairs can be selected for performing measuring runs. In this example the measuring runs are performed consecutively without extra return runs to floor F1, speeding up the performance of the measuring runs.

TABLE 2

| Floor pair | Run distance (floors) |
|---|---|
| F1-F10 | (9) |
| F10-F9 | (1) |
| F9-F1 | (8) |
| F1-F3 | (2) |
| F3-F10 | (7) |
| F10-F7 | (3) |
| F7-F1 | (6) |
| F1-F5 | (4) |
| F5-F10 | (5) |

By the aid of the measuring runs also a so-called call advance can be determined. A call advance refers to the time before which a call must be given to a moving elevator to a floor on the run route in order for the elevator to have time to stop at the floor in question. If the call advance is too short, the elevator registers this so-called advance call but serves other calls first until it changes its drive direction and returns after it to the floor according to the advance call (if the call has not been served already by some other elevator).

A call advance is illustrated in FIG. 2, which presents the speed profile of an elevator when the elevator is driving from floor F1 to floor F5. In FIG. 2:

on the x axis is the run time t on the y axis is the run speed v of the elevator T5 is the run time from floor F1 to floor F5 determined on the measuring runs T4 is the run time from floor F1 to floor F4 determined on the measuring runs X call advance for stopping on floor F4

T4'=T4−X, the time when a call for stopping at floor F4 is generated for elevator.

For determining the call advance X, the procedure can be e.g. as follows:

at first the run times between floor pairs are determined in the manner described above (T4 for floor pairs F1-F4, T5 for floor pairs F1-F5 in FIG. 2), a suitable initial value is selected for the call advance X, the floor pair, between which floors the measuring run (F1-F5 in FIG. 2) will be performed is selected, during the measuring run an advance call to some floor between the selected floor pair is generated, e.g. to the floor preceding the destination floor of the measuring run (to floor F4 at the time T4' in FIG. 2), the run time of the measuring run is measured, the measured run time is compared to the run times (T4 and T5 in FIG. 2) between floor pairs, it is deduced on the basis of the comparison whether the elevator stopped at the floor (F4) according to the advance call or whether the elevator continued without stopping to the original destination floor (F5) of the measuring run, if the elevator stopped at the floor (F4) according to the advance call, the call advance X is shortened, if the elevator stopped at the original destination floor (F5), the call advance X is lengthened, the measuring run described above is repeated until the desired termination condition is fulfilled, e.g. the call advance X becomes so short that the elevator does not have time to stop at the floor according to the advance call, the value of the call advance is determined and it is recorded in the run time parameters for later use. The value can be e.g. the shortest measured call advance with which the elevator can be brought to stop at the desired floor.

In the example case according to FIG. 2 described above, the elevator reaches the nominal speed Vn during the measuring run, so the call advance X can be applied to all cases in which the elevator reaches nominal speed. For those cases in which the run distance is too short for reaching the nominal speed Vn, the call advance X must be separately determined. For example, if in the example described above the advance call is given to floor F2 instead of floor F4, a call advance X' is obtained for a case having a run distance that corresponds to one floor-to-floor distance.

Since the elevators of an elevator group are generally almost identical, the run time parameters determined with one elevator can be used as common parameters of all the elevators of the elevator group. If that is not so, it is possible that measuring runs will have to be driven with more than one elevator and the run time parameters recorded for each specific elevator.

When the run time parameters in the elevator system according to FIG. 1 have been determined and recorded in the memory of the new group control, the elevators of the elevator group can be used for transporting passengers at the same time as one or more elevators are out of transport operation owing to the modernization. During transport operation the new group control registers the calls given by passengers and distributes them between the modernized and unmodernized elevators. The distribution of calls can be based on allocation methods that are, per se, known in the art, in which the aim is to optimize one or more performance indicators of the elevator system, e.g. to minimize the waiting time of passengers.

Since the new group control is aware of the position data of each elevator or, if the elevator is moving, the data connected to the run (departure floor of run, drive direction, time used from the departure floor for the run), the new group control can, utilizing the run parameters, calculate a forecast for the run time of the elevator to a floor from which a call was given. For stationary elevators, a run time forecast from the current floor to the call-giving floor is obtained directly from the run time parameters. A run time forecast of a moving elevator is obtained by deducting from the aforementioned run time forecast the time already used for the run. If there are stops on the run route, for collecting passengers from a floor and/or for leaving them on a floor, a suitable stopping time forecast can be added to the run time forecast. The stopping time forecast can be a fixed parameter and/or a run time parameter determined by the aid of measuring runs.

In the new group control, stationary elevators as well as moving elevators having a remaining run time to the call-giving floor that is greater than the corresponding call advance are included in the allocation monitoring of calls. If the shortest run time forecast is obtained for an elevator to be modernized, the new group control transmits the registered call to the old group control, which allocates an elevator to serve the call from the plurality of unmodernized elevators; in other cases the new group control allocates an elevator to serve the call from the plurality of modernized elevators.

When the elevators are in normal transport operation the new group control monitors the run times between floor pairs. If the run times differ from the run times determined on the basis of the run time parameters, the run time parameters are updated such that they more accurately correspond to the run times measured during transport operation. Correspondingly, the run time parameters determining call advances can be updated by monitoring during transport operation whether a moving elevator has time to stop at a floor according to an advance call. A suitable value for a call advance can be adaptively sought by alternately lengthening and alternately shortening the call advance, and by monitoring whether an elevator stops for a given call according to the call advance of the elevator.

Marked with the reference number 114 in FIG. 1 is a position sensor, which is installed in the elevator hoistways of the elevators to be modernized, e.g. on floor level F1, and connected to the new group control via the overlay 113 (only one position sensor is presented in FIG. 1). By the aid of the position sensors 114 the position data of the elevators can be calibrated by driving the elevator cars 102 (102*a* . . . 102*d*) to floor level F1 and by detecting the arrival of the elevator cars from the signal of the aforementioned sensors. After calibration the position data of each elevator is updated by monitoring the run time and drive direction of the elevator, by comparing the run time to the run times determined by the aid of measuring runs, and by deducing between which floor pair the run performed by the elevator was. The run distance of the floor pair for which the run time determined by measuring runs best corresponds to the run time measured during transport operation is added or deducted from the current position data, depending on the drive direction.

FIG. 3 presents a second elevator group according to the invention. The elevator group 200 according to FIG. 3 differs from the elevator group according to FIG. 1 in that, inter alia, the old group control 111 is removed immediately in the starting phase of the modernization and in that the new group control 110 is connected via the overlay 113 to the elevator controls of the elevators to be modernized for giving run commands directly from the new group control to the elevator controls 120 as well as for reading the status data of the elevators from the elevator controls 120. In this solution the allocation decisions are made in the new group control 110 and are transmitted as calls or as corresponding run commands both to an elevator to be modernized and directly to the elevators already modernized.

Although the invention above is described by the aid of examples of modernization of an elevator group, the invention is not only limited to modernizations of elevator systems, but instead many other applications and adaptations are possible within the scope of the attached claims.

The invention claimed is:

1. A method for determining the parameters connected to the run times of elevators and for using said parameters in controlling the elevators in an elevator system, which elevator system includes one or more elevators, wherein the method comprises:

selecting a plurality of floor pairs from a plurality of floors served by the elevators;

measuring runs between the selected floor pairs with one or more elevators;

registering run events connected to the measured runs;

determining, on the basis of the run events, a plurality of run time parameters connected to the run times; and controlling the elevators based on the aforementioned run time parameters when the elevators are in transport operation.

2. The method according to claim 1, wherein the run time parameters are determined as a function of one or more of a drive direction of the elevator and a car load.

3. The method according to claim 1, wherein measuring runs are performed by automatically generating calls to floors according to selected floor pairs.

4. The method according to claim 3, wherein the elevator to perform a measuring run is selected by placing the other elevators into an operating mode that prevents the other elevators from driving on the basis of automatically generated calls.

5. The method according to claim 1, wherein the method further comprises:

generating, during a measuring run, a call to a floor between the floor pair at a time determined by the given call advance;

changing the call advance on the basis of the run events registered during the measuring run;

repeating the measuring run while changing the call advance until a termination condition for the repetition is fulfilled;

determining the value of the call advance on the basis of the repeated measuring runs; and recording the value of the call advance for use in controlling elevators when the elevators are in transport operation.

6. The method according to claim 1, wherein the method further comprises:

registering run events of elevators when the elevators are in the transport operation; and updating the run time parameters on the basis of the run events registered during the transport operation.

7. The method according to claim 1, wherein at least one elevator is provided with a position sensor, and the method further comprises:

calibrating the position data of the elevator by driving the aforementioned elevator to a floor detected by the position sensor;

registering, the direction data and run time of the run performed with the elevator; and updating the position data of the elevator based on the direction data and by comparing the run time to the run times between floor pairs obtained on the basis of the run time parameters.

8. The method according to claim 1, wherein in connection with modernization of the elevator system, run time parameters are determined for one or more elevators that are to be modernized, which run time parameters are used in controlling elevators to be modernized when the elevators are in transport operation during the modernization.

9. The method according to claim 8, further comprising:

distributing the calls given by passengers between unmodernized and modernized elevators by utilizing the run time parameters.

10. An elevator system, comprising:

one or more elevators; and a control system configured to, automatically generate calls for elevators for performing measuring runs between desired floor pairs, which floor pairs are selected from the plurality of floors to be served by the elevators, register run events connected to the measuring runs, determine on the basis of the run events a plurality of run time parameters, and control the elevators using the determined run time parameters when the elevators are in transport operation.

11. The elevator system according to claim 10, wherein the control system is configured to determine the plurality of run time parameters as a function of one or more of a drive direction of the elevator and a car load.

12. The elevator system according to claim 10, wherein each elevator of the elevator system can be placed into an operating mode that prevents the control system from driving an elevator on the basis of the automatically generated calls.

13. The elevator system according to claim 10, wherein the control system is configured to, generate, during a measuring run, a call to a floor between the floor pair at a time determined by the given call advance;

change the call advance on the basis of the run events registered;

repeat the measuring run until a desired termination condition is fulfilled;

determine the value of the call advance on the basis of the measuring runs performed;

record the call advance in the run time parameters for use in controlling elevators when the elevators are in transport operation.

14. The elevator system according to claim 13, wherein the control system is configured to, register the run events of elevators when the elevators are in the transport operation; and update the run time parameters on the basis of the run events registered during the transport operation.

15. The elevator system according to claim 10, further comprising:

a position sensor associated with at least one elevator, the position sensor configured to detect the position of the elevator car, the position sensor connected to the control system of the elevator system, wherein the control system is configured to, calibrate the position data of the elevator on the basis of the signal produced by the position sensor, register the direction data and run time of a run performed with the elevator, and update the position data of the elevator on the basis of the direction data, the run time and the determined run time parameters.

16. The elevator system according to claim 10, wherein the elevator system is an elevator group that is to be modernized, the elevator group including one or more elevators to be modernized, and the control system includes a new control system and an old control system, which transmit data to each other via an overlay connecting the control systems, the new control system being configured to determine the run time parameters for at least one elevator to be modernized.

17. The elevator system according to claim 16, wherein the elevator system comprises:

at least one modernized elevator and at least one unmodernized elevator, wherein the new control system is configured to, register the calls given by passengers with the call giving devices, and distribute the calls between modernized and unmodernized elevators by utilizing the run time parameters determined for the elevators.

* * * * *